United States Patent [19]

Nelson et al.

[11] Patent Number: 4,498,634

[45] Date of Patent: Feb. 12, 1985

[54] DIVISION HEAD FOR GRINDING MILL

[75] Inventors: Jeffrey A. Nelson, Bethlehem; Kenneth W. Hanstine, Walnutport, both of Pa.

[73] Assignee: Fuller Company, Bethlehem, Pa.

[21] Appl. No.: 528,677

[22] Filed: Sep. 1, 1983

[51] Int. Cl.[3] ..... B02C 17/06

[52] U.S. Cl. ..... 241/72; 241/179

[58] Field of Search ..... 241/153, 171, 176, 177, 241/178, 179, 70, 71, 72

[56] References Cited

U.S. PATENT DOCUMENTS

| | | | |
|---|---|---|---|
| 628,141 | 7/1899 | Emerick | 241/72 |
| 3,633,832 | 1/1972 | Fegerholt | 241/70 |
| 3,801,025 | 2/1972 | Slegten | 241/70 |
| 4,171,102 | 2/1978 | Slegten | 241/70 |

FOREIGN PATENT DOCUMENTS

| | | | |
|---|---|---|---|
| 127832 | 11/1938 | Fed. Rep. of Germany | 241/72 |

*Primary Examiner*—Mark Rosenbaum

*Attorney, Agent, or Firm*—Frank H. Thomson

[57] ABSTRACT

A division head for a tubular grinding mill for controlling the level of material being ground in the upstream compartment of the mill. The division head is formed by a plurality of hollow pie shaped segments covered on the upstream side by grates which permit material to flow into the division head and liners and on the downstream side. A partition divides the pie shaped segments into radially inward sections and a radially outward section. Material within the radially inward sections flows out of the division head into a downstream compartment of the mill through a central discharge cone. Some of the radially outward sections are flow connected directly to the radially inward sections through an opening in the partition dividing the pie shaped segments. Dampers are provided for controlling flow of material through the opening connecting radially outward sections with radially inward sections. By controlling flow out of the radially outward sections, flow into those sections is controlled and the level of material in the upstream mill compartment can be controlled.

11 Claims, 7 Drawing Figures

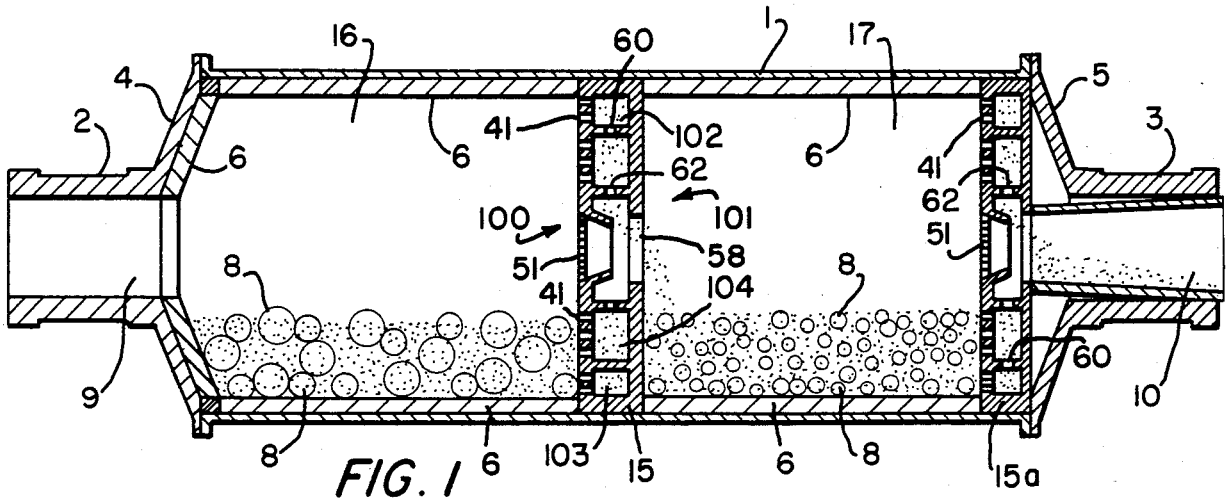
FIG. 1
FIG. 2
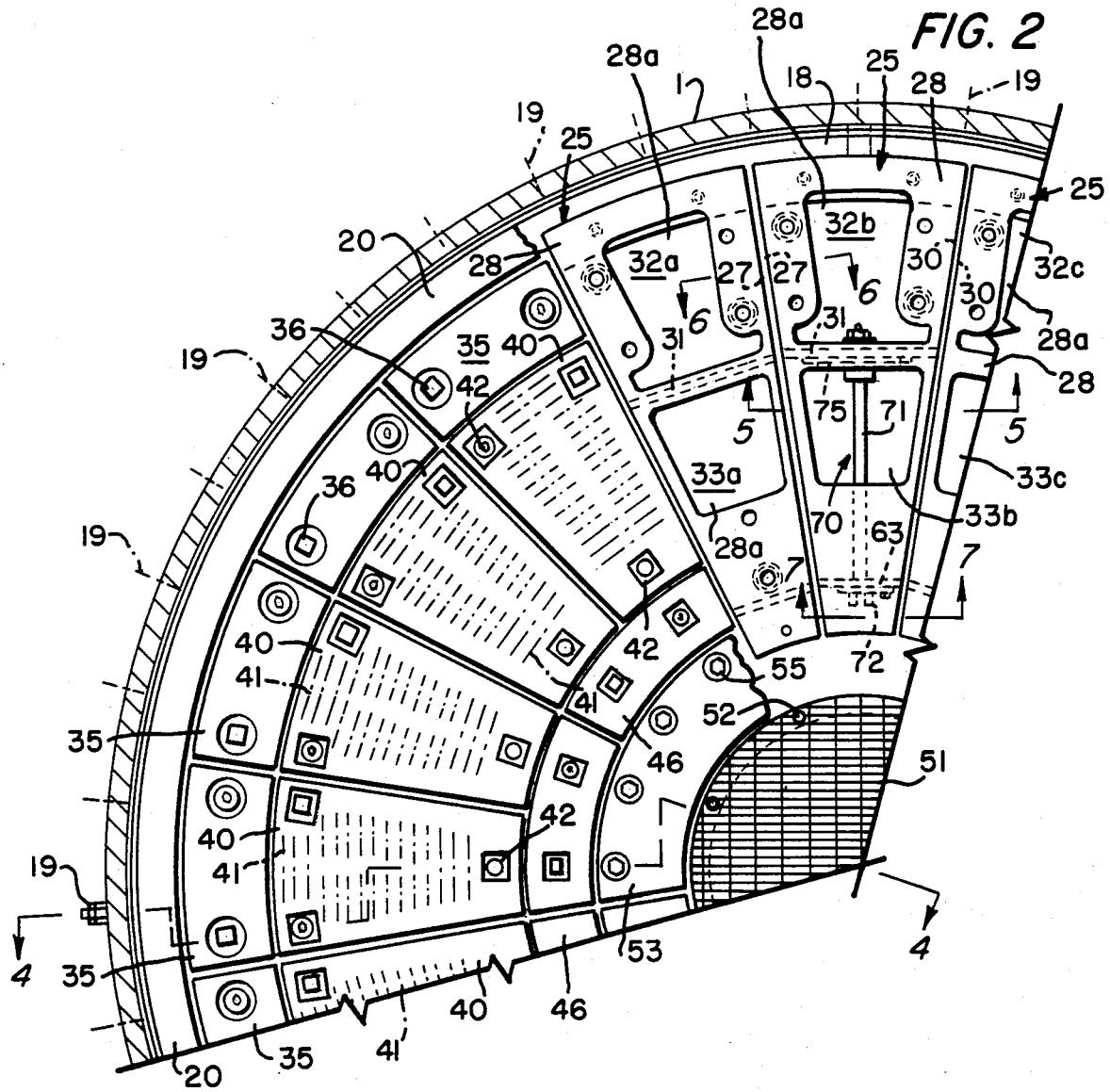

25
1
20
18
29
31
73
75
27
30
63
72
70
59
51
35a
36
44
43
47
48
54
56

63
62
72
77
28
30
76
27
29
78

43
31
29
75
70
60
73
30
28
40
41
27
28a
80

DIVISION HEAD FOR GRINDING MILL

BACKGROUND OF THE INVENTION

This invention relates to tubular grinding mills such as ball or rod mills wherein a tubular mill shell having an inlet for course material to be ground and an outlet for finely ground material has grinding media such as balls or rods within the shell whereby as the mill shell is rotated about its own axis the grinding media is tumbled within the mill shell to comminute the material. Mills of this type are typically used in the grinding of cement raw meal, cement clinker or the grinding of ores. More particularly, the present invention relates to a division head for use in such a grinding mill for dividing the mill into compartments.

Typically, a grinding mill of the type in which the present invention is utilized will include various size grinding balls within the mill with the larger balls being in the upstream or inlet side of the mill and the smaller balls being in the downstream or outlet side of the mill. A division head may be utilized within the head to divide the mill into compartments. In a given compartment there may be various size grinding balls but as a general statement, the larger balls are in the first or upstream compartment and the smaller balls are in the second or downstream compartment. The larger balls serve to reduce the size of the course incoming feed to a smaller size to thereby achieve a first size reduction. The smaller balls are used to achieve a second, final size reduction in the downstream compartment.

Material flow through a grinding mill depends upon both size reduction and displacement of material. The flow is dependent upon size reduction in that at either the discharge from a compartment or the discharge from the mill, grates are provided which have openings sufficiently large to permit the passage of material of a given size but sufficiently small to prevent both the grinding media and oversize material to be ground from passing from one compartment either into the next compartment or out of the ball mill. The flow of material through the mill is also governed by displacement in that as material is fed into the mill a substantially equal amount of material is discharged from the mill.

It is desireable to control the level of material within a given compartment of the mill in order to have adequate material within the mill to retain the material within a compartment or the mill long enough to achieve proper size reduction. In addition, since the material being ground which is dispersed between the grinding media acts as a cushion and lubricant to thereby reduce the wear rate on the grinding balls and the mill liners, maintaining a desired level of material within the mill serves to prolong the life of the grinding media.

Prior to the present invention it was known to provide a means for controlling the flow of material from one compartment of a tubular grinding mill to a second compartment of that tubular grinding mill or to the discharge of the mill. Two such devices are shown in U. S. Pat. Nos. 3,801,025 and 4,171,102 both of which utilize a means defining a reservoir of material within a partition in the mill and a scoop arrangement for picking up material from that reservoir and feeding it through a central discharge into the next compartment or to the outlet of the mill. A further device for controlling the flow of material through a mill is illustrated in U.S. Pat. No. 3,633,832.

SUMMARY OF THE INVENTION

The present invention relates to a division head for a tubular grinding mill with the division head formed by an upstream wall with an annular grate having openigs with a size sufficiently large to permit the passage of ground material therethrough but sufficiently small to prevent the passage of grinding media. A downstream wall is axially spaced from the upstream wall and has a central discharge passage. The annular space between the upstream and downstream walls is divided by a first partition into radially inward sections and radially outward sections. Both sections are in communication with the upstream mill compartment through the grates. Second partitions divide the annular space into pie shaped segments. The radially inward sections of each pie shaped segment communicate with the central discharge cone so that material flowing through the grate into the radially inward sections will, when the section is above the mill axis, flow into the discharge passage and then into the second compartment. Some of the radially outward sections communicate with the radially inward sections to permit material which enters the radially outward section to flow to the inward section and hence to the discharge passage and the second compartment. The remaining outward sections do not communicate directly with the inward section but instead are flow connected to an adjacent radially outward section so that when a section fills with material it flows to an adjacent outward section for flow through an inward section to the discharge passage.

A damper is provided between some of the radially outward sections and the radially inward sections is control the flow of material from the outward section into the inward section. This control allows the radially outward section to be completely or partially closed from communication with the discharge passage.

By controlling the flow out of a radially outward section, flow of material into the radially outward sections is controlled. As a result, the level of material in a given compartment of the mill can be controlled within the height of the radially outward section.

Because many dampers are utilized in the present invention as compared with the few scoops utilized in U.S. Pat. Nos. 3,801,025 and 4,171,102, a greater degree of control can be provided to thereby provide a greater control over the depth of material within a given compartment. In addition, the present invention provides an arrangement which permits simple adjustment of the damper arrangement to provide relatively easy control of the level of material within a given compartment.

The present invention also provides an arrangement of construction which utilizes segmented grates and liner plates which permit the replacement of only those grates or liner plates which are worn rather than replacing all grates or plates in the division head. In addition, the arrangment of the present invention allows one division head to be utilized in a variety of size mills.

It is therefore the principal object of the present invention to provide a division head for a tubular grinding mill which is capable of controlling the level of material within an upstream compartment of the mill.

It is another object of this invention to provide a division head for a tubular grinding mill which is made up of parts so that it is capable of being used in different sizes of grinding mills.

In general, foregoing and other objects will be carried out by providing in a tubular grinding mill, a division head extending transversely within the grinding mill downstream of one compartment in the mill, said division head including an upstream wall with an annular grate having openings therein of a size sufficiently large to permit the passage of ground material therethrough and sufficiently small to prevent the passage of grinding media; a downstream wall axially spaced from said upstream wall and having a central discharge passage; first partition means dividing the space between the upstream wall and the downstream wall into a radially inward section and a radially outward section, each normally flow connected to said one compartment through said grate said radially inward section being flow connected to said central discharge passage; a plurality of openings in said first partition means flow connecting portions of said radially outward section to the radially inward section so that when the mill rotates, material in the radially outward section above the mill axis can flow through said openings into said radially inward section and material in the radially inward section will flow through said central discharge passage; and valve means for controlling the flow of material from the radially outward section to the radially inward section.

BRIEF DESCRIPTION OF THE DRAWINGS

The invention will be described in connection with the annexed drawings wherein:

FIG. 1 is a vertical section through a grinding mill utilizing the division head of the present invention;

FIG. 2 is a plan view of the upstream side of a division head according to the present invention with parts broker away for clarity;

DESCRIPTION OF THE PREFERRED EMBODIMENT

Figure 3:
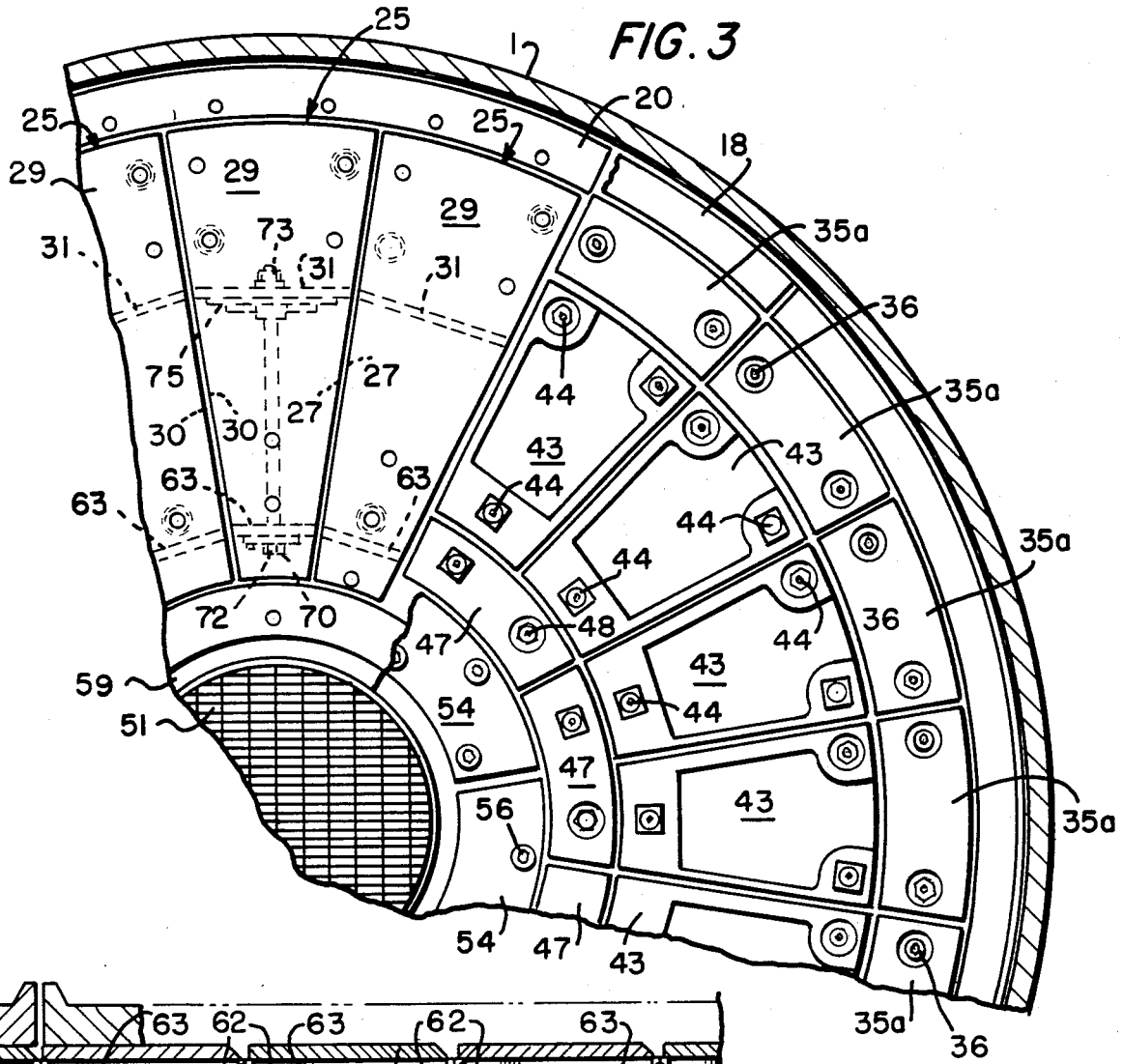
FIG. 3 is a view similar to FIG. 2 but showing the downstream side of the division head.

Referring to FIG. 1, there is diagramatically shown a tubular grinding mill which includes a shell 1 which is mounted for rotation about its own axis by means of journals 2 and 3 at opposite ends of the mill. The journals 2 and 3 may be integrally cast with the mill heads 4 and 5 respectively. As is usual in the art, the inside of the shell 1 is lined with replaceable wear resistant liners 6. Grinding media 8 such as balls or rods is located in the mill for the purpose of comminuting the coarse material fed through to the mill. The journal 2 has a large opening 9 therein which acts as an inlet for coarse material to be ground and the journal 3 includes a large opening 10 which serves as an outlet for fine material which has been ground. As the mill is rotated about its own axis by suitable means known in the art, the grinding media or balls and material to be grounded tumble within the mill to comminute the coarse material and grind it into a fine material. It should be noted that while the present invention has been illustrated in connection with a trunnion supported mill, the invention is equally applicable in a shell supported grinding mill.

The present invention particularly relates to the division head generally designated at 15 and positioned transversely within the mill perpendicular to the axis of the mill to divide the mill into a first compartment 16 and a second compartment 17. While the division head of the present invention will be particularly described as it is used to divide a mill into an upstream or first compartment and a downstream or second compartments it should be noted that the present invention may also be used at the end of the mill to control the level of material within the compartment 17. For this purpose, the division head at the end of the mill has been designated at 15*a*. The division head of the present invention has for its primary purpose permitting the flow of fine material from an upstream compartment to either a downstream compartment or, depending upon its location at 15 or 15*a*, to the discharge of the mill and at the same time controlling the level of material being ground within its associated upstream compartment, be it compartment 16 or compartment 17.

Figure 4:
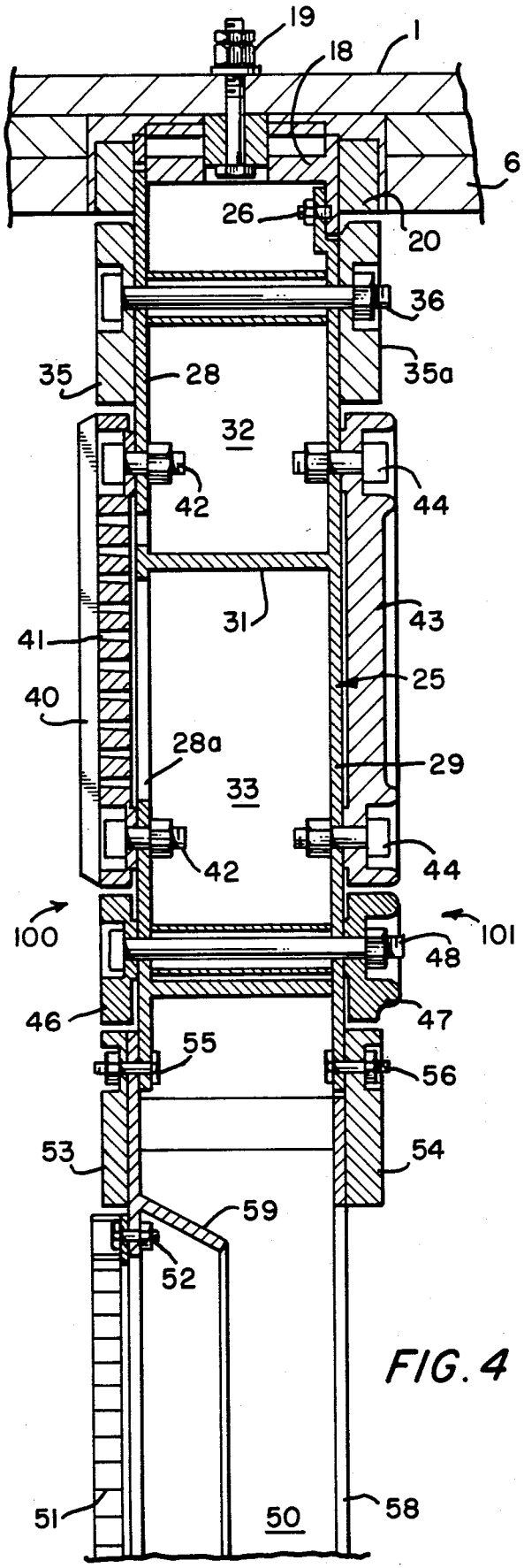
FIG. 4 is a sectional view of a portion of a division head taken on the line 4—4 of FIG. 2.

Referring more specifically to FIGS. 2 to 7, the division head of the present invention whether it is positioned at 15 or 15*a* is essentially identical and is formed by an outer rim 18 secured as by bolts 19 to the shell 1 as illustrated in FIG. 4. The annular rim 18 may be made up a plurality of segments to form an annular ring. The radial height of the rim 18 may be selectively sized for a given size mill so that the balance of the division head can be utilized in different size mills. A filler segment plate 20 fits between the rim 18 and the liners 6 of the mill shell to assure proper alignment of the division head transverse to the mill.

A plurality of hollow pie shaped segments 25 are secured as by bolts 26 to the ring member 18 and to each other as by welding in a contiguous manner to form a hollow annular member which is the frame of the division head 15. The inner portion of the annular configuration of the division head is secured to axially spaced apart annular members 53 and 54 by means of bolts 55 and 56 to form a center passage through the division head.

Each panel member 25 may be a fabricated piece including walls 27, 28, 29 and 30. A first partition 31 divides the inside of the pie shaped member 25 into a radially outward section 32 and a radially inward section 33.

Figure 5:
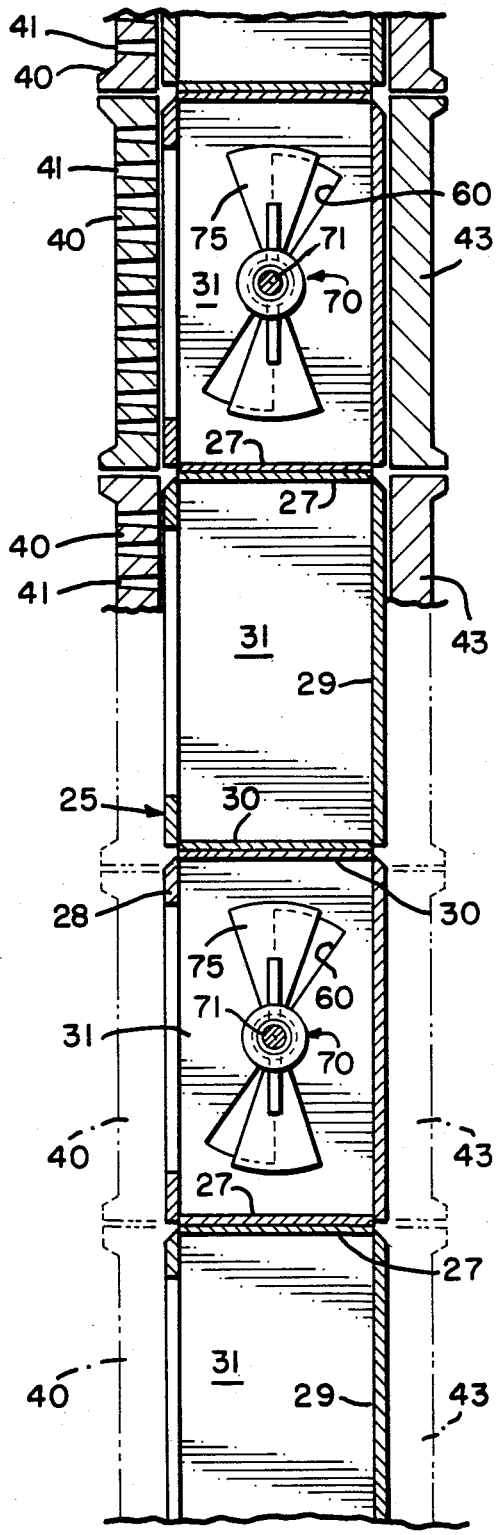
FIG. 5 is a sectional view of a portion of a division head according to the present invention taken generally on the line 5—5 of FIG. 2 looking in the direction of the arrow.

Liner segments 35 and 35*a* are secured as by bolts 36 to opposite sides of the pie shaped element 25 as shown in FIGS. 2, 3 and 4. A grate member 40 having openings 41 therein is secured by means of bolts 42 to the wall 28 of each pie shaped segment 25 on the upstream side of the division head 15. When the grate members of all segments are in place, an annular grate is formed. As shown in FIGS. 4 and 5, the wall 28 is open as at 28*a* to permit material to flow from the first compartment 16 through the grate openings 41 into the radially inward section 33 and the radially outward section 32. A solid wear resistant liner member 43 is secured by bolts 44 to the wall 29 of each pie shaped segment 25 on the downstream side of the division head 15. Because liners 43 are solid, direct communication between the inside of the division head and the downstream compartment is prevented.

The inner portion of each pie shaped segment 25 has liner segments 46 and 47 secured to opposite sides of the division head by means of bolt 48.

The central portion of the division head defines a central passage 50 through the mill outlined by the annular members 53 and 54. A grate element 51 is secured by bolts 52 to the upstream side of the division head while the downstream side is open at 58 to define a central discharge passage from the division head. A center cone 59 is secured to the upstream side of the central passage 50 by bolts 52 and 55. The grate 51 has openings sufficiently small to prevent the passage of grinding media there through yet large enough to allow air for drying material within the mill to pass through the mill. Normally, material being ground does not pass through the grate 51 as the depth of material within the grinding mill is not sufficient to reach the height of grate 51.

When viewing FIGS. 1 and 4, it will be seen that the division head 15 includes an upstream wall 100 defined by walls 28 of segments 25,, liners 35, rates 40 and liner segments 46 and 51. The division also includes a downstream wall 101, spaced from the upstream wall and defined by walls 29 of segment 25, liners 35*a*, 43 and 47 annular member 54. The downstream wall includes the central discharge passage 58.

Figure 7:
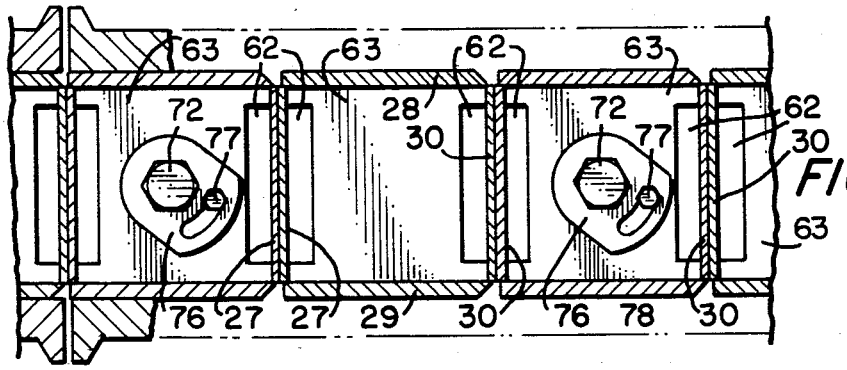
FIG. 7 is a sectional view of a portion of the division head of the present invention taken on the line 7—7 of FIG. 2 looking in the direction of the arrow.

At least some of the pie shaped members 25 have an opening 60 in the partition 31 dividing the inside of the division head into radially inward sections 33 and radially outward sections 32 to permit communication between the radially outward section and the radially inward section 33 of the division head. The remaining pie shaped members 25 have solid partitions 31 to prevent direct communication between a radially outward section and a radially inward section. In the preferred embodiment, the members 25 which have an opening 60 alternate with members having a solid partition 31. Each of the radially inward sections 33 is in communication with the central passsge 50 through passages 62 in bottom plates 63 (FIG. 7). In this manner, the upstream compartment 16 is in communication with the downstream compartment 17 through grate 40 by means of openings 41 into radially inward section 33, through openings 62, passage 50 and outlet 58 into the downstream compartment 17 or outlet 10.

By the present invention a valve means 70 has been provided for controlling the size of the openings 60 in partition 31 to thereby control the flow of materially from radially outward section 32 into radially inward section 33. The valve means 70 includes a shaft 71 extending from the lower plate 63 to the partition 31 through the radially inward section 33. The shaft may be in the form of a bolt with a head 72 at the lower plate 63 and the nut 73 at the outer surface of plate 31. A two blade damper 75 is positioned to selectively close the inner surface of the opening 60 in partition 31. At the plate 63, an adjustment mechanism consisting of a slotted plate 76 and bolt 77 are positioned to permit the damper member 75 to either fully open, fully close or be infinitely adjustable there between to control the size of opening 60. By adjusting the positioning of damper 75, the amount of material which can flow from radially outward section 32 into radially inward section 33 and thus into the discharge cone 50 can be controlled. Adjustment is accomplished by first loosening bolt 77, rotating plate 76, both 72 and damper blade 75 about the axis of the bot so that adjusting plate 76 moves along slot 78 then retightening bolt 77. This adjustment is accomplished while the mill is down. The adjustment mechanism is accessible from the central passage 50.

Figure 6:
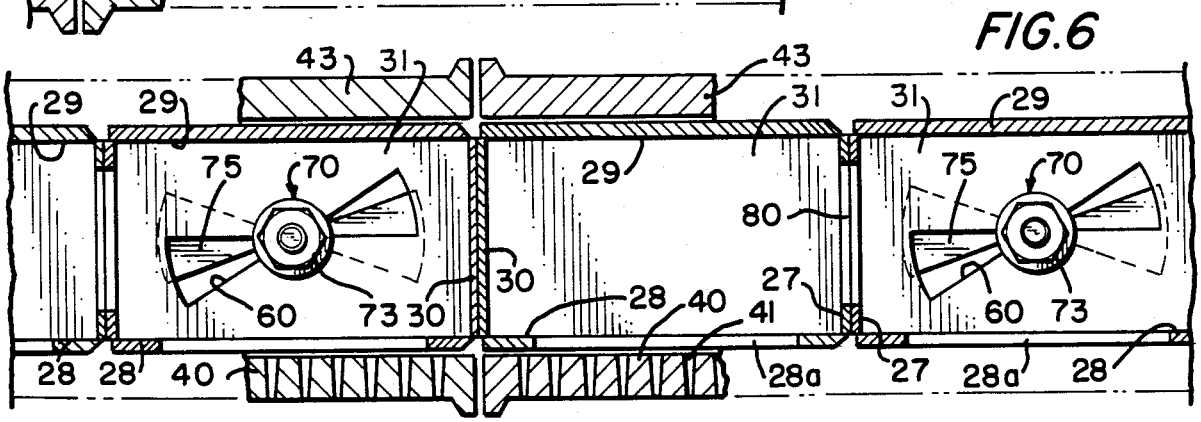
FIG. 6 is a view similar to FIG. 5 but taken on the line 6—6 of FIG. 2 looking in the direction of the arrow.

Preferrably alternate pie shaped members 25 have the aforedescribed valve means to permit and control communication between the radially outward sections 32 and the radially inward sections 33 with the remaining pie shaped members having a solid partition. It should be noted that while in FIGS. 2 and 3 only a single valve means 70 has been shown, there are a plurality of valve means with one operatively associated with each opening 60 and preferrably in alternate pie shaped segments 25 around the circumference of the division head. There is communication from one radially outward section 32 to an adjacent radially outward section 32. As shown in FIG. 6, this communication is provided by a passage 80 defined by an opening 80 in adjacent walls 27 of segment 25. In this manner, material which flows through grate 40 into a radially outward section 32 may either flow directly through opening 60 into radially inward section 33 to central passage 50 or as the mill rotates the material, may flow into an adjacent radially outward section 32 through opening 80 then through passage 60 to central passage 50.

In the configuration shown, the division head includes an upstream wall 100 and a downstream wall 101 with a first partition means 102 formed by contiguous partitions 31 dividing the space between the upstream wall 100 and the downstream wall into a radially outward section 103 formed by contiguous and communicating sections 32 and a radially inward section 104 formed by sections 33. The radially outward section 103 and radially inward section are normally flow connected to the upstream compartment through grates 40. The radially inward section is flow connected to the central discharge passage 58 in downstream wall 101 through opening 52. The plurality of spaced apart openings 60 in the first partition means 102 serve to flow connect portions of the radially outward section 103 to the radially inward section 104. The valve means 70 control the flow of material from the radially outward section to the radially inward section. The walls 27 and 30 serve as second partition means to divide the radially outward and radially inward sections into pie shaped segments. Alternate second partitions have openings 80 to permit communication between adjacent section 32.

As the tubular grinding mill rotates, the grinding balls 8 and material to be ground tumble within the mill compartments 16 and 17 to comminute the material within the compartment. Finer material will pass through grates 40 into the division head 15 or 15*a* into both the radially inward section 33 and the radially outward section 32. As the mill rotates and pie shaped segment 25 moves above the mill axis, material within radially inward sections 33 will spill through openings 62 into the central passage 50. Cone 59 directs the material to central outlet 58 into the downstream compartments 17 or mill outlet 10. At the same time, if the damper 75 is positioned so that opening 60 in partition 31 is open, material in a radially outward section having an opening 60 will flow into its associated radially inward section. Material in a radially outward section 32 which does not have an opening 60 may flow into an adjacent section 32 through opening 80. For example, in FIG. 2, material in section 32*a* may flow into section 32*b* through an opening 80 and then through an opening 60 to discharge 58. However, section 32*b* and 32*c* in FIG. 2 are preferably not in communication with each other. On the other hand, if a damper 75 is closed, material within radially outward section 32 will be blocked with the section.

By controlling the number of valves 70 that are open or closed, the depth of material within the upstream compartment can be controlled. For example, if all valves 70 are closed, material within the upstream compartment will flow through grate 40 into radially outward section 103 until all sections 32 are full of material. Because the radially outward sections are full, and no additional material can pass into that section, the depth of material within the upstream compartment such as compartment 16 will fill to a height at least up to the partition 102 (FIG. 1). If it is desired to maintain a lesser depth of material in the upstream compartment, some of the dampers 75 can be opened to allow some of the radially outward sections 32 to be emptied into radially inward sections 33 as the mill is rotated. If all of the dampers are opened, the mill can be emptied so that the level of material in the upstream compartment is to the depth of the liners 35.

With the present invention similar parts can be used in a variety of sizes of mills. A given size pie shaped segment can be used in a variety of mill sizes by changing the radial depth of rim 18 so that for a small mill, rim 18 is shallow and for a large diameter mill,, rim 18 is deep. The size of the liners are adjusted by using wider or narrower liners 35 and 35*a* or 46 and 47.

From the foregoing it should be apparent that the objects of the present invention have been carried out. A division head has been provided which permits the level of material within an upstream compartment of the grinding mill to be controlled.

The invention permits a single grate design to be utilized in many diameter mills by adjusting the height of the rim segment 18. The various wear liner pieces can be changed as they are worn without changing all liner segments of the division head because the liners are broken up into several pieces.

It is intended that the foregoing be a description of a preferred embodiment and the invention be limited solely by that which is within the scope of the appended claims.

We claim:

1. In a tubular grinding mill having a shell supported at its ends for rotation about its own axis, an inlet for coarse material to be ground, an outlet for fine ground material, and grinding media such as grinding balls within the shell for comminuting material, a division head for dividing the mill into a first compartment and a second compartment, permitting the flow of material being ground from the first compartment to the second compartment, while substantially preventing the flow of grinding media between the first and second compartments and controlling the level of material within the first compartment comprising:

means defining a rim member adapted to be secured to the inside of the shell;

a plurality of hollow pie shaped contiguous panel members secured to each other and to said rim member to form a hollow annular member having a center cone and each panel member having one side facing the first compartment and another side facing the second compartment;

a plurality of grates having openings therethrough, each mounted on one side of the panel members for permitting material in the first compartment to flow into the annular member;

a plurality of solid liners, each mounted on the other side of the panel members for preventing direct communication between the hollow annular member and the second compartment;

at least some of said pie shaped members having an internal partition dividing the pie shaped member into radially inward and radially outward sections;

said radially inward section being flow connected to the center cone so that material in the first compartment can flow through the grates into the radially inward section and from the radially inward section through the center cone to the second compartment;

at least some of said pie shaped panel members having an opening in its internal partition so that when the mill rotates, material in the radially outward sections above the mill axis will flow into the radially inward section, and the remaining pie shaped members having solid partitions; and a plurality of valve means each operative associated with one of the openings in said internal partitions for controlling the flow of material from the radially outward section to the radially inward section.

2. In a tubular grinding mill according to claim 1, at least some of said pie shaped members having openings in the radially outward sections for permitting material within the radially outward section having an opening therein to flow to an adjacent radially outward section.

3. In a tubular grinding mill according to claim 2, the pie shaped members having an opening in its internal partition alternate circumferentially with pie shaped members which have a solid partition between the radially inward section and the radially outward section.

4. In a tubular grinding mill according to claim 3 wherein a radially outward section of a pie shaped member having a solid partition communicates with only one of its adjacent pie shaped members having a partition with an opening therein.

5. In a tubular grinding mill according to claim 1 wherein each of said valve means is an adjustable damper for controlling the size of the opening with which it is associated for controlling the volume of material which flows from the radially outward section to the radially inward section.

6. In a tubular grinding mill according to claim 5 wherein each of said valve means includes means accessible from the center cone for adjusting the position of said damper for controlling the size of said opening.

7. In a tubular grinding mill, a division head extending transversely within the grinding mill downstream of one compartment in the mill, said division head including an upstream wall with an annular grate having openings therein of a size sufficiently large to permit the passage of ground material therethrough and sufficiently small to prevent the passage of grinding media; a downstream wall axially spaced from said upstream wall and having a central discharge passage; first partition means dividing the space between the upstream wall and the downstream wall into a radially inward section and a radially outward section, each normally flow connected to said one compartment through said grate; said radially inward section being flow connected to said central discharge passage; a plurality of openings in said first partition means flow connecting portions of the radially outward section to the radially inward section so that when the mill rotates material in the radially outward section above the mill axis can flow through said openings into said radially inward section and material in the radially inward section will flow through said central discharge passage; and valve means for controlling the flow of material from the radially outward section to he radially inward section.

8. In a tubular mill according to claim 7 wherein said openings in said first partition are circumferentially spaced and said valve means includes a plurality of damper means, each operatively associated with one of said openings in said partitions and adjustable to control the size of the opening with which it is associated.

9. In a tubular grinding mill according to claim 8 further comprising a plurality of second partition means dividing said radially inward section and said radially outward section into a plurality of pie shaped segments; each of said second partition means being positioned between adjacent circumferentially spaced openings in said first partition to thereby define first radially outward sections which are flow connected to first radially inward sections through said openings in said first partition and second radially outward sections which are isolated from second radially inward sections.

10. In a tubular grinding mill according to claim 9 wherein circumferentially alternate second partitions have at least one opening therethrough which permits the second radially outward section to be flow connected to the first radially outward section.

11. In a tubular grinding mill according to claim 10 further comprising means accessable from the central discharge passage for adjusting said damper means.

* * * * *